US007367401B2

(12) United States Patent
Moffett et al.

(10) Patent No.: US 7,367,401 B2
(45) Date of Patent: May 6, 2008

(54) PORTED VELOCITY TUBE FOR GAS LIFT OPERATIONS

(75) Inventors: Charles I. Moffett, Jena, LA (US); Thomas S. Kirkpatrick, Whitehouse, TX (US); Dallis A. Smith, Marshall, TX (US); Joshua C. Little, Longview, TX (US)

(73) Assignee: Smith International, Inc., Houston, TX (US)

( * ) Notice: Subject to any disclaimer, the term of this patent is extended or adjusted under 35 U.S.C. 154(b) by 283 days.

(21) Appl. No.: 10/999,272

(22) Filed: Nov. 29, 2004

(65) Prior Publication Data

US 2006/0113082 A1 Jun. 1, 2006

(51) Int. Cl.
*E21B 43/00* (2006.01)
*E21B 33/12* (2006.01)

(52) U.S. Cl. ..... 166/372; 166/387; 166/106

(58) Field of Classification Search ..... 166/372, 166/387, 68, 68.5, 106
See application file for complete search history.

(56) References Cited

U.S. PATENT DOCUMENTS 3,182,726 A * 5/1965 Stone, Jr. ..... 166/145
3,268,004 A * 8/1966 Kiel ..... 166/106
4,545,731 A * 10/1985 Canalizo et al. ..... 417/86
4,708,595 A 11/1987 Maloney et al.
5,022,427 A * 6/1991 Churchman et al. ..... 137/155
5,113,939 A * 5/1992 Ross et al. ..... 166/120
5,875,852 A * 3/1999 Floyd et al. ..... 166/387
6,082,452 A * 7/2000 Shaw et al. ..... 166/105.5
2003/0024704 A1* 2/2003 Hirsch et al. ..... 166/313
2006/0076140 A1* 4/2006 Rouen ..... 166/312

* cited by examiner

*Primary Examiner*—William P Neuder
(74) *Attorney, Agent, or Firm*—Conley Rose, P.C.

(57) ABSTRACT

An apparatus for use with a packer set within a well bore comprises a first flow path providing fluid communication between the well bore above the packer and the well bore below the packer, and a second flow path. A system for gas lifting fluids from a well bore with a packer set therein defining an upper portion and a lower portion of the well bore comprises production tubing, the packer, and a ported velocity tube. A method for producing a fluid from a well bore zone below a set packer disposed in a production tubing comprises injecting a gas into a well bore annulus formed by the production tubing, flowing the gas downwardly through the packer, jetting the gas into the well bore zone, and flowing the fluid upwardly through the packer into the production tubing.

18 Claims, 3 Drawing Sheets

PORTED VELOCITY TUBE FOR GAS LIFT OPERATIONS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates generally to apparatus and methods for use during gas-lift operations in a well bore. More particularly, the present invention relates to a ported velocity tube that delivers gas below a production packer to a perforated zone, and a cost-efficient method of unloading a well bore below a production packer.

BACKGROUND OF THE INVENTION

Gas-lift operations may be employed in hydrocarbon wells as a primary recovery technique for lifting fluids, such as water or oil, from the well. One type of gas-lift operation comprises injecting gas downwardly from the surface into the well bore annulus formed between production tubing and the well bore wall or casing. As the gas is injected from the surface, it gradually reduces the density of the column of fluid in the well from top to bottom. As the density of the fluid is reduced, the fluid becomes lighter until the natural formation pressure is sufficient to push the fluid up and out of the well through the production tubing, typically through gas-lift valves disposed at spaced locations along the production tubing.

Using this gas-lift method, a completed well that is ready to be placed on production, for example, may be unloaded of water to thereby remove the hydrostatic head created by the water and enable the flow of the lighter produced hydrocarbons from the formation into the well bore. When gas-lift valves are employed to unload the well, the well bore annulus may be packed off below the gas-lift valves to reduce the volume of fluid that must be lightened by the gas and unloaded through the valves. The gas-lift valves close sequentially from top to bottom automatically when the fluid has been lifted out through the production tubing and injection gas remains in the well bore annulus at that depth. By this means, each succeeding lower gas-lift valve is closed as the fluid level in the annulus is successively lowered until the lowermost gas-lift valve is exposed to the injection gas in the annulus. Thereafter, gas lift does not occur below the packer, but because the well bore annulus has been unloaded above the packer, the natural formation pressure may be sufficient to push the column of produced fluid up and out of the well through the production tubing.

The above-described method may be sufficient for gas-lifting a standard length well. However, this method may be ineffective to gas-lift long, multi-zone or deviated production wells. In particular, a high pressure gas would be required to sufficiently lighten a very long column of fluid. However, it is undesirable to inject high pressure gas into the annulus because such gas would overcome the formation pressure and inject into the perforations, thereby preventing production fluids from flowing into the well.

Gas-lifting operations for long, multi-zone or deviated production wells may be improved by using a production packer to seal the well bore annulus so that the well above the packer may be unloaded to thereby reduce the hydrostatic head. However, because gas cannot be injected below the packer, and because the packer must be set above the perforated zone, even using a packer may be insufficient to effectively gas-lift a well down to the last production interval when the well bore extends some distance beyond the packer.

Other types of gas-lift operations exist, such as, for example, an inner string extending from the surface through the production tubing to inject gas into the fluid in the production tubing, but such apparatus and methods can be cost prohibitive. Therefore, a need exists for apparatus and methods to effectively gas-lift a long, multi-zone or deviated production well. In particular, a need exists for apparatus and methods that enable gas injection directly to the perforated zone below the production packer, and a cost-efficient method of unloading a well bore below a production packer.

SUMMARY OF THE INVENTION

An apparatus is disclosed for use with a packer set within a well bore comprising a first flow path providing fluid communication between the well bore above the packer and the well bore below the packer, and a second flow path. In an embodiment, the first flow path comprises an inner string extending through the packer into the well bore below the packer, and an inlet port extending between the well bore above the packer and the inner string. The inner string may be installable or removable by slick line when the apparatus is in the well bore. In an embodiment, the apparatus further comprises a blanking plug at an upper end of the inner string that blocks a primary flowbore.

In another aspect, a system is disclosed for gas lifting fluids from a well bore with a packer set therein defining an upper portion and a lower portion of the well bore comprising a production tubing, the packer, and a ported velocity tube comprising a gas flow path in communication between the upper portion and the lower portion of the well bore, and a fluid flow path in communication with the production tubing. In an embodiment, the ported velocity tube is connected between the production tubing and the packer. In various embodiments, the gas flow path comprises an inner tubing that extends through the packer, and may also comprise a radially extending port between the upper portion and the inner tubing. At least a portion of the gas flow path may be installable or removable when the system is disposed within the well bore.

In yet another aspect, a method is disclosed for producing a fluid from a well bore zone below a set packer disposed in a production tubing comprising injecting a gas into a well bore annulus formed by the production tubing, flowing the gas downwardly through the packer, jetting the gas into the well bore zone, and flowing the fluid upwardly through the packer into the production tubing. In an embodiment, the steps of flowing the gas and flowing the fluid may occur simultaneously.

NOTATION AND NOMENCLATURE

Certain terms are used throughout the following description and claims to refer to particular apparatus components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", or "upstream" meaning toward the earth's surface and with "down", "lower", or "downstream" meaning toward the bottom of the well bore.

DETAILED DESCRIPTION

Figure 1:
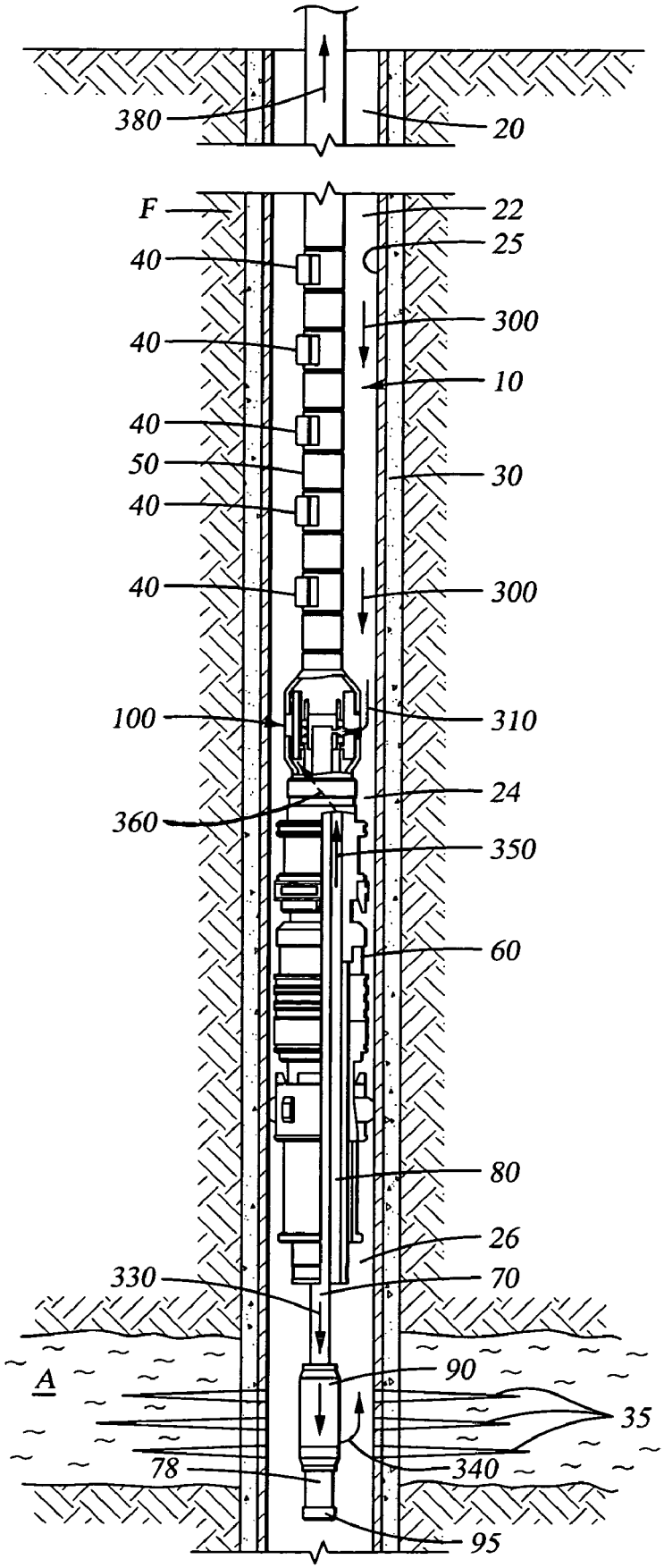
FIG. 1 is a schematic view, partially in cross-section, of an exemplary operating environment for a ported velocity tube, depicting a completion system disposed within a well bore extending into a subterranean hydrocarbon formation.

FIG. 1 schematically depicts an operating environment for one embodiment of a ported velocity tube 100, described in more detail below. As depicted, a completion system 10 extends downwardly into a well bore 20 to form a well bore annulus 22 therebetween. The well bore 20 penetrates a subterranean formation F for the purpose of recovering hydrocarbons, and at least a portion of the well bore 20 may be lined with casing 25 that is cemented 30 into position against the formation F in a conventional manner. Perforations 35 extend through the casing 25 and cement 30 into a lowermost producing zone A in the formation F to provide a path for the flow of fluids from the producing zone A into the well bore 20.

The completion system 10 may take a variety of different forms. In the embodiment depicted in FIG. 1, the completion system 10 comprises a plurality of gas-lift valves 40 spaced along a production tubing 50, a ported velocity tube 100 (referred to hereinafter as PVT 100), a production packer 60, and an inner tubing string 70 suspended from the PVT 100 and extending through the production packer 60 to form a flow annulus 80 within the packer 60. In an embodiment, an injection valve 90 and a bull plug 95 may also be connected toward the lower end of the inner tubing string 70, which terminates adjacent the perforations 35. While the completion system 10 shown in FIG. 1 depicts a quantity of five gas-lift valves 40, one of ordinary skill in the art will readily appreciate that the number and spacing of gas-lift valves 40 may change without departing from the scope of the present invention. Additional components may also be provided as part of the completion system 10.

In an embodiment, the production packer 60 is a standard, double-grip production packer, such as the M1-X™ packer or the Versalock™ packer, both available from Smith International, Inc. of Houston, Tex. The production packer 60 is set against the casing 25 to thereby form a plug that isolates an upper portion 24 from a lower portion 26 of the well 20. The PVT 100 enables gas that is injected into the well bore annulus 22 to flow from the upper well bore portion 24 to the lower well bore portion 26 through the inner tubing string 70, as will be described in more detail herein.

Figure 2:
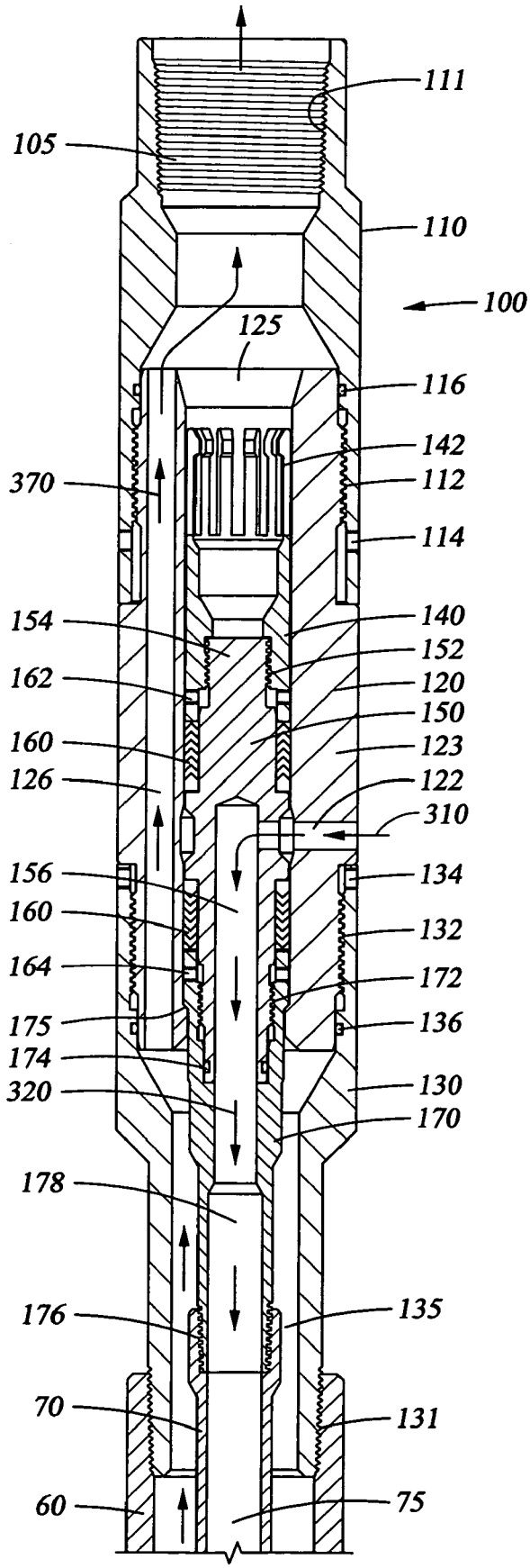
FIG. 2 is an enlarged cross-sectional side view of one embodiment of a ported velocity tube.

FIG. 2 depicts an enlarged cross-sectional side view of one embodiment of the PVT 100 comprising a top sub 110 with longitudinal flow bore 105, a bypass connector 120 with a longitudinal flow bore 125, and a bottom sub 130 with a longitudinal flow bore 135. The top sub 110 connects via threads 112, set screws 114, and O-ring seals 116 to the bypass connector 120; which in turn connects via threads 132, set screws 134, and O-ring seals 136 to the bottom sub 130. The bypass connector 120 comprises an inlet port 122 that extends radially through a wall 123 of the bypass connector 120 to provide fluid communication with the well bore annulus 22. The bypass connector 120 further comprises a return port 126 that extends longitudinally through the wall 123 of the bypass connector 120. API connectors 111, 131 are provided at the upper and lower ends of the PVT 100, respectively, for connecting the PVT 100 to other components, such as the production tubing 50 on the upper end and the packer 60 on the lower end, for example.

Still referring to FIG. 2, the PVT 100 further comprises a landing sub 140, a blanking plug 150, V-packing seals 160, and a tubing crossover sub 170 all disposed within the bore 125 of the bypass connector 120 and extending into the bore 135 of the bottom sub 130. The landing sub 140 connects via threads 152 to the blanking plug 150, which in turn connects via threads 172 and O-ring seals 174 to the tubing crossover sub 170. The tubing crossover sub 170 includes a lower threaded end 176 to connect to the inner tubing string 70 that extends through the packer 60 into the lower well bore portion 26 as depicted in FIG. 1.

Figure 3:
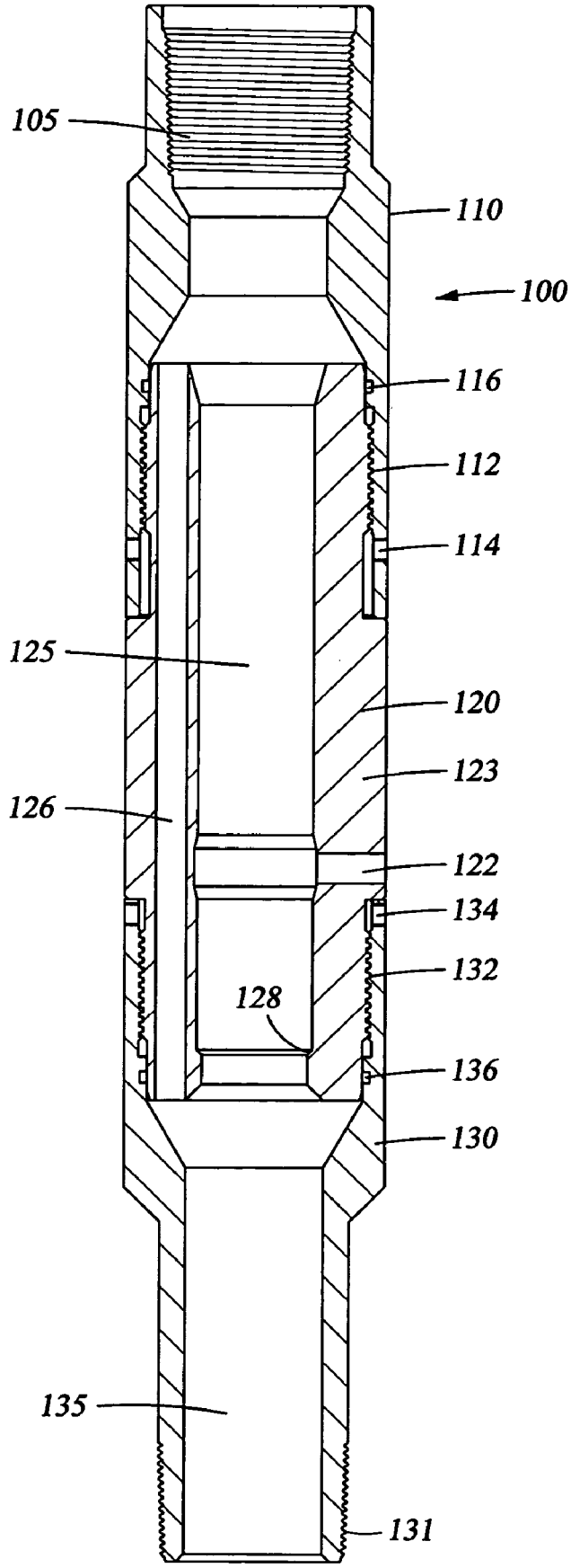
FIG. 3 is an enlarged cross-sectional side view of the ported velocity tube of FIG. 2, depicting the inner string and other internal components of the ported velocity tube removed.

Referring now to FIG. 2 and FIG. 3, the landing sub 140 comprises a standard slick line profile 142 that enables slick line retrieval and/or installation of the internal components, namely the landing sub 140, blanking plug 150, V-packing seals 160, tubing crossover sub 170, and the inner tubing string 70, when the PVT 100 is already disposed in the well 20. FIG. 3 depicts the PVT 100 after removal of these internal components 140, 150, 160, 170, and 70, which may be desirable for a variety of reasons during operation. For example, if a leak develops in any of these internal components 140, 150, 160, 170 and 70, a slick line can be run down to engage the upper profile 142 and retrieve the components for field replacement. Then the slick line can run the landing sub 140, blanking plug 150, V-packing seals 160, tubing crossover sub 170, and the inner tubing string 70 back into the well 20 for re-installation in the PVT 100. As shown in FIG. 3, bypass connector 120 comprises an internal shoulder 128 corresponding to an external shoulder 175 on the tubing crossover sub 170 as shown in FIG. 2. The internal shoulder 128 thereby provides a stop for the external shoulder 175 for proper positioning of the internal components 140, 150, 160, 170 and 70 within the PVT 100 when they are installed via slick line.

Referring now to FIG. 2, the blanking plug 150 comprises a plug portion 154 that acts to block fluid flow downwardly through the bore 125 of the bypass connector 120, and a flow bore 156 in fluid communication at its upper end with the inlet port 122 of the bypass connector 120. Flow bore 156 is also in fluid communication with a flow bore 178 in the tubing crossover sub 170, which in turn is in fluid communication with the bore 75 of the inner tubing string 70. Thus, inlet port 122 and flow bores 156, 178, 75 thereby provide a continuous fluid flow path for fluid communication between the upper well bore portion 24 and the lower well bore portion 26. V-packing seals 160 are disposed between the blanking plug 150 and the bypass connector 120, above and below the inlet port 122 of the bypass connector 120, and the seals 160 are held in place by set screws 162, 164, respectively. The plug portion 154 and the V-packing seals 160 act to isolate the inlet port 122 from fluid disposed in the bore 125 of the bypass connector 120.

In operation, the PVT 100 provides a path for gas that is injected into the well bore annulus 22 to flow from the upper portion 24 of the well 20 to the lower portion 26 of the well 20 to enable gas-lift operations below the set packer 60. Referring again to FIG. 1, after the completion assembly 10 is run into the well bore 20, and the packer 60 has been set against the casing 25, the wellhead (not shown) is installed at the surface to maintain control of the well 20. Then the well 20 is ready to be placed on production. However, the well bore annulus 22 is full of water that was previously used for well control before the wellhead was installed. Therefore, the water must be removed from the well 20 to allow fluid flow out of the production zone A of the formation F through the perforations 35. Thus, in an embodiment, the water is unloaded from the well bore annulus 22 via conventional gas-lift methods above the packer 60. Namely, gas is injected from the surface into the well bore annulus 22 until the density of the water is reduced sufficiently to allow natural formation pressure to push the water out of the well 20. The water may be unloaded through the production tubing 50 to the surface of the well 20 using the gas-lift valves 40, which automatically open sequentially from top to bottom. This gas-lift operation continues until gas reaches the PVT 100 in the upper portion 24 of the well 20. In an embodiment, the gas-lift valves 40 are used only for unloading the upper portion 24 of the well 20 above the packer 60 before the gas flow is routed through the PVT 100, at which point the gas-lift valves 40 are inactive and remain closed.

Once the water has been unloaded from the upper portion 24 of the well 20, gas that is injected into the annulus 22 flows downwardly to the PVT 100, as represented by flow arrows 300 in FIG. 1. As shown in FIG. 1 and FIG. 2, the gas flow continues through the inlet port 122 of the PVT 100 as indicated by flow arrow 310, which leads into the flow bores 156, 178 of the blanking plug 150 and crossover tubing connector 170, respectively, as indicated by flow arrows 320. The flow continues downwardly through the packer 60 via the inner tubing string 70, and emerges along flow path 330 to finally jet outwardly through the injection valve 90 as indicated by flow arrow 340 into the lower portion 26 of the well bore 20 adjacent the perforations 35. If the gas contains any debris, at least some of that debris will fall out and be captured within the section 78 of tubing string 70 below the injection valve 90, which is plugged at the bottom by bull plug 95.

As the gas jets out into the lower portion 26 of the well 20, the gas mixes with the production fluid to lighten the fluid until the bottomhole pressure of the formation F is sufficient to push the production fluid upwardly along flow path 350 through the packer 60 via the flow annulus 80 formed between the inner tubing string 70 and the bore of the packer 60. As the production fluid continues to flow upwardly, it will be routed along flow path 360 into the PVT 100. This fluid flow will continue along path 370 through the return port 126 and into the longitudinal flow bore 105 of the top sub 110. The production fluid continues to flow upwardly along path 380 through the production tubing 50 and up to the surface of the well 20. As indicated by the flow arrows 310, 320, 370 shown in FIG. 1 and FIG. 2, the PVT 100 is designed to accommodate gas flow through inlet port 122 and production fluid flow through return port 126 simultaneously. In one embodiment of the method for gas-lifting a well 20 below a production packer 60, the gas injection and return of production fluid to the surface is a continuous operation.

Therefore, the PVT 100 is a simple device with no moving parts that is designed for gas-lift operations to enhance liquid recovery by decreasing the fluid density and increasing the gas lifting power below the production packer 60. The PVT 100 works with a standard, low-cost, double-grip packer 60 so that fluid above the packer 60 can be unloaded from the well 20 via the gas-lift valves 40, and then gas can be injected through the PVT 100 to lighten the produced fluid in the lower portion 26 of the well so that it can be lifted through the production tubing 50 to the surface of the well 20. With proper placement of the inner tubing string 70, the benefits of gas lift can be achieved even at the lowermost producing zone A. In particular, gas can be delivered directly to the perforations 35 extending into producing zone A, making the PVT 100 particularly useful in wells 20 with multi-production zones or in deviated wells where the packer 60 has to be set a great distance from the perforations 35. The inner tubing string 70 can be run in place with the completion system 10, or may be run through the production tubing 50 on slick line and landed in the PVT 100. The PVT 100 is expected to enhance hydrocarbon fluid recovery for most gas-lift operations, either onshore or offshore. In an embodiment, at least some of the components of the PVT 100 comprise L80 grade steel or stainless steel, thereby making the PVT 100 suitable for sour production service or other liquid services.

The foregoing descriptions of specific embodiments of the completion system 10 and PVT 100, as well as the methods for unloading a well 20 below a production packer 60, were presented for purposes of illustration and description and are not intended to be exhaustive or to limit the apparatus and methods to the precise forms disclosed. Obviously many other modifications and variations are possible. In particular, the type of completion system 10, or the particular components that make up the completion 10 may be varied. Further, the placement of the PVT 100 within the well bore 20 may be varied. For example, the PVT 100 could be positioned anywhere along the completion system 10 or within the well bore annulus 22, so long as it functions to inject gas into the lower portion 26 of the well bore 20 below the production packer 60. Many other variations, combinations, and modifications of the invention disclosed herein are possible and are within the scope of the invention, and as such, the embodiments described here are exemplary only, and are not intended to be limiting.

Accordingly, while various embodiments of the invention have been shown and described herein, modifications may be made by one skilled in the art without departing from the spirit and the teachings of the invention. The different teachings of the embodiments discussed herein may be employed separately or in any suitable combination to produce desired results. Accordingly, the scope of protection is not limited by the description set out above, but is defined by the claims which follow, that scope including all equivalents of the subject matter of the claims.

What is claimed is:

1. An apparatus for use with a packer set within a well bore comprising:

a first flow path providing fluid communication between the well bore above the packer and the well bore below the packer; and a second flow path in communication with the first flow path;

wherein an outlet of the first flow path is below an inlet of the second flow path.

2. The apparatus of claim 1 wherein the first flow path comprises:

an inner string extending though the packer into the well bore below the packer; and an inlet port extending between the well bore above the packer and the inner string.

3. The apparatus of claim 2 wherein the inner string is installable or removable by slick line when the apparatus is in the well bore.

4. The apparatus of claim 2 wherein the inner string is disposed within a primary flow bore.

5. The apparatus of claim 4 further comprising a blanking plug at an upper end of the inner string that blocks the primary flowbore.

6. The apparatus of claim 4 wherein the second flow path comprises a secondary flowbore.

7. The apparatus of claim 6 wherein the secondary flowbore is adjacent the primary flowbore.

8. The apparatus of claim 1 further comprising one or more parts, the one or more parts remaining motionless during use.

9. The apparatus of claim 1 further comprising connection ends for connecting the apparatus to a tubing string and the packer.

10. A system for gas lifting of fluids from a well bore with a packer set therein defining an upper portion and a lower portion of the well bore comprising:

a production tubing;

the packer; and a ported velocity tube comprising:

a gas flow path in communication between the upper portion and the lower portion of the well bore; and a fluid flow path in communication with the production tubing and the gas flow path wherein an outlet of the gas flow path is below an inlet of the fluid flow path.

11. The system of claim 10 wherein the ported velocity tube is connected between the production tubing and the packer.

12. The system of claim 10 wherein the gas flow path comprises an inner tubing that extends through the packer.

13. The system of claim 12 wherein the gas flow path further comprises a radially extending port between the upper portion and the inner tubing.

14. The system of claim 10 wherein at least a portion of the gas flow path is installable or removable when the system is disposed within the well bore.

15. The system of claim 10 wherein the ported velocity tube comprises one or more parts, the one or more parts remaining motionless during use.

16. The system of claim 10 wherein the system allows simultaneous flow along the gas flow path and the fluid flow path.

17. A method for producing a fluid from a well bore zone below a set packer disposed in a production tubing comprising:

injecting a gas into a well bore annulus formed by the production tubing;

flowing the gas downwardly through the packer;

jetting the gas into the well bore zone; and flowing the fluid upwardly through the packer into the production tubing.

18. The method of claim 17 wherein the steps of flowing the gas and flowing the fluid may occur simultaneously.

* * * * *